US010627842B2

(12) United States Patent
Lu et al.

(10) Patent No.: US 10,627,842 B2
(45) Date of Patent: Apr. 21, 2020

(54) LOSSLESS CURRENT BALANCING AND SHARING BETWEEN PARALLELED LINEAR VOLTAGE REGULATORS

(71) Applicant: Analog Devices Global Unlimited Company, Hamilton (BM)

(72) Inventors: Danzhu Lu, Shanghai (CN); Brandon Day, Seattle, WA (US); Yihui Chen, Shanghai (CN); Jie He, Shanghai (CN)

(73) Assignee: Analog Devices Global Unlimited Company, Hamilton (BM)

( * ) Notice: Subject to any disclaimer, the term of this patent is extended or adjusted under 35 U.S.C. 154(b) by 0 days.

(21) Appl. No.: 16/011,467

(22) Filed: Jun. 18, 2018

(65) Prior Publication Data

US 2019/0384337 A1 Dec. 19, 2019

(51) Int. Cl.
*G05F 1/575* (2006.01)
*G05F 1/565* (2006.01)
(Continued)

(52) U.S. Cl.
CPC ..... *G05F 1/575* (2013.01); *G05F 1/563* (2013.01); *G05F 1/565* (2013.01); *G05F 1/59* (2013.01)

(58) Field of Classification Search
CPC . G05F 1/575; G05F 1/565; G05F 1/59; G05F 1/10; G05F 1/46; G05F 1/461;
(Continued)

(56) References Cited

U.S. PATENT DOCUMENTS 6,642,631 B1 * 11/2003 Clavette ..... H02J 1/102 307/52
7,015,847 B1 * 3/2006 McLachlan ..... H03M 1/1205 341/144

(Continued)

FOREIGN PATENT DOCUMENTS

EP 2634902 9/2013

OTHER PUBLICATIONS

"European Application Serial No. 9179424.7, Extended European Search Report dated Nov. 21, 2019", 15 pgs.

*Primary Examiner* — Gustavo A Rosario-Benitez
(74) *Attorney, Agent, or Firm* — Schwegman Lundberg & Woessner, P.A.

(57) ABSTRACT

The subject disclosure includes paralleling of monolithic embedded low drop-out (LDO) linear regulator power rails to provide additional load current, while maintaining accurate current sharing and balancing between the paralleled LDOs without additional power consumption for different load current requirements. Lossless current sensing is used to sense the current for each channel. An offset generator compares the voltages for a master channel and one or more slave channels, and generates an offset voltage according to the sensed error. The offset voltage is added between an input reference voltage and an output regulated voltage to cancel the offset of each channel, so the current of each channel is substantially the same. The lossless current sensing can be realized with equivalent series resistance compensation or current limit sensing. The offset generator can be realized with a resistor and current mirror topology or an input pair added to an error amplifier input.

23 Claims, 7 Drawing Sheets

(51) Int. Cl.
*G05F 1/59* (2006.01)
*G05F 1/563* (2006.01)

(58) Field of Classification Search
CPC ..... G05F 1/563; G05F 1/614; G05F 1/613; H02M 2001/007; H02M 2001/0077; H02M 3/1584
See application file for complete search history.

(56) References Cited

U.S. PATENT DOCUMENTS

| | | | | |
|---|---|---|---|---|
| 7,336,058 | B1 * | 2/2008 | Lo | G05F 1/575 323/269 |
| 8,710,810 | B1 * | 4/2014 | McJimsey | H02M 3/1584 323/272 |
| 9,748,830 | B1 * | 8/2017 | Soleno | H02J 1/102 |
| 10,216,209 | B1 * | 2/2019 | Ham | G05F 1/59 |
| 10,263,524 | B2 * | 4/2019 | Hang | H02M 3/1584 |
| 2005/0078424 | A1 | 4/2005 | Yamamura et al. | |
| 2005/0110561 | A1 * | 5/2005 | Mehas | G01R 31/3004 327/541 |
| 2010/0026254 | A1 | 2/2010 | Kao et al. | |
| 2010/0164289 | A1 | 7/2010 | Umminger et al. | |
| 2014/0097818 | A1 * | 4/2014 | Wiktor | H02M 3/156 323/283 |
| 2014/0277812 | A1 * | 9/2014 | Shih | G05F 1/563 700/298 |
| 2014/0375288 | A1 * | 12/2014 | Nora | H02M 3/1584 323/272 |
| 2015/0188427 | A1 * | 7/2015 | Yorozu | H02M 3/158 323/271 |
| 2016/0154415 | A1 * | 6/2016 | Bîzîitu et al. | G05F 1/575 323/280 |

* cited by examiner

LOSSLESS CURRENT BALANCING AND SHARING BETWEEN PARALLELED LINEAR VOLTAGE REGULATORS

FIELD OF THE DISCLOSURE

The present description relates generally to electrical mixed-signal circuits, and more particularly, to lossless current balancing and sharing between paralleled linear voltage regulators.

BACKGROUND

Many high performance mixed-signal products, such as high speed analog-to-digital converters (ADCs) and digital-to-analog converters (DACs), agile radio frequency (RF) transceivers, clocking, application specific integrated circuits (ASICs), and field programmable gate arrays (FPGAs) typically use ultralow noise, low drop-out (LDO) linear voltage regulators to provide clean supplies to maximize signal chain performance. With high demands of more integrated functionalities and lower power consumptions, those large scale mixed-signal integrated circuits (IC) feature a design with lower geometry process to fit more transistors. This trend affects its power requirements as well. The core supply voltage keeps reducing, but with significantly increased load current, to adopt more analog or digital functionalities in recent years.

SUMMARY OF THE DISCLOSURE

The subject disclosure includes paralleling of monolithic embedded low drop-out (LDO) linear regulator power rails to provide additional load current, while maintaining accurate current sharing and balancing between the paralleled LDOs without additional power consumption for different load current requirements. Lossless current sensing is used to sense the current for each channel. An offset generator compares the voltage for a master channel and one or more slave channels, and generates an offset voltage according to the sensed error. The offset voltage is added between an input reference voltage and an output regulated voltage to cancel the offset of each channel, so the current of each channel is substantially the same. The lossless current sensing can be realized with equivalent series resistance compensation or current limit sensing. The offset generator can be realized with a resistor and current mirror topology or an input pair added to an error amplifier input.

According to an embodiment of the present disclosure, an apparatus for lossless current sharing between paralleled voltage regulators is provided. For example, the apparatus includes a first regulator circuit for driving a load with a first output voltage based on a first output current. The apparatus also includes one or more second regulator circuits coupled in parallel to the first regulator circuit and configured to drive the load with respective second output voltages based on respective second output currents. The apparatus also includes one or more comparator circuits coupled to the first regulator circuit and the one or more second regulator circuits, in which the one or more comparator circuits are configured to compare the first output voltage to each of the respective second output voltages to determine offset voltages for each of the first regulator circuit and the one or more second regulator circuits, and provide, based on the determined offset voltages, respective signals to the one or more second regulator circuits to cause the one or more second regulator circuits to adjust the respective second output voltages such that output currents of the one or more second regulator circuits correspond to an output current of the first regulator circuit.

According to an embodiment of the present disclosure, an apparatus for current sharing between paralleled voltage regulators is provided. The apparatus includes a first voltage regulator and a second voltage regulator coupled to opposing terminals of the first voltage regulator. In some aspects, the second voltage regulator is configured to compare a first output voltage of the first voltage regulator to a second output voltage of the second voltage regulator; produce an offset signal based on the comparison; and bias the second voltage regulator with the offset signal to cancel a voltage offset between the first voltage regulator and the second voltage regulator.

According to an embodiment of the present disclosure, a system for lossless current sharing between paralleled voltage regulators is provided. The system includes means for measuring a first output current of a first voltage regulator, and means for measuring a second output current of a second voltage regulator. The system includes means for comparing a first output voltage corresponding to the first output current with a second output voltage corresponding to the second output current, and means for producing an offset signal based on the comparison. The system also includes means for biasing the second voltage regulator with the offset signal to cancel a voltage offset between the first voltage regulator and the second voltage regulator.

BRIEF DESCRIPTION OF THE DRAWINGS

Certain features of the subject technology are set forth in the appended claims. However, for purposes of explanation, several embodiments of the subject technology are set forth in the following figures.

DETAILED DESCRIPTION

Figure 1:
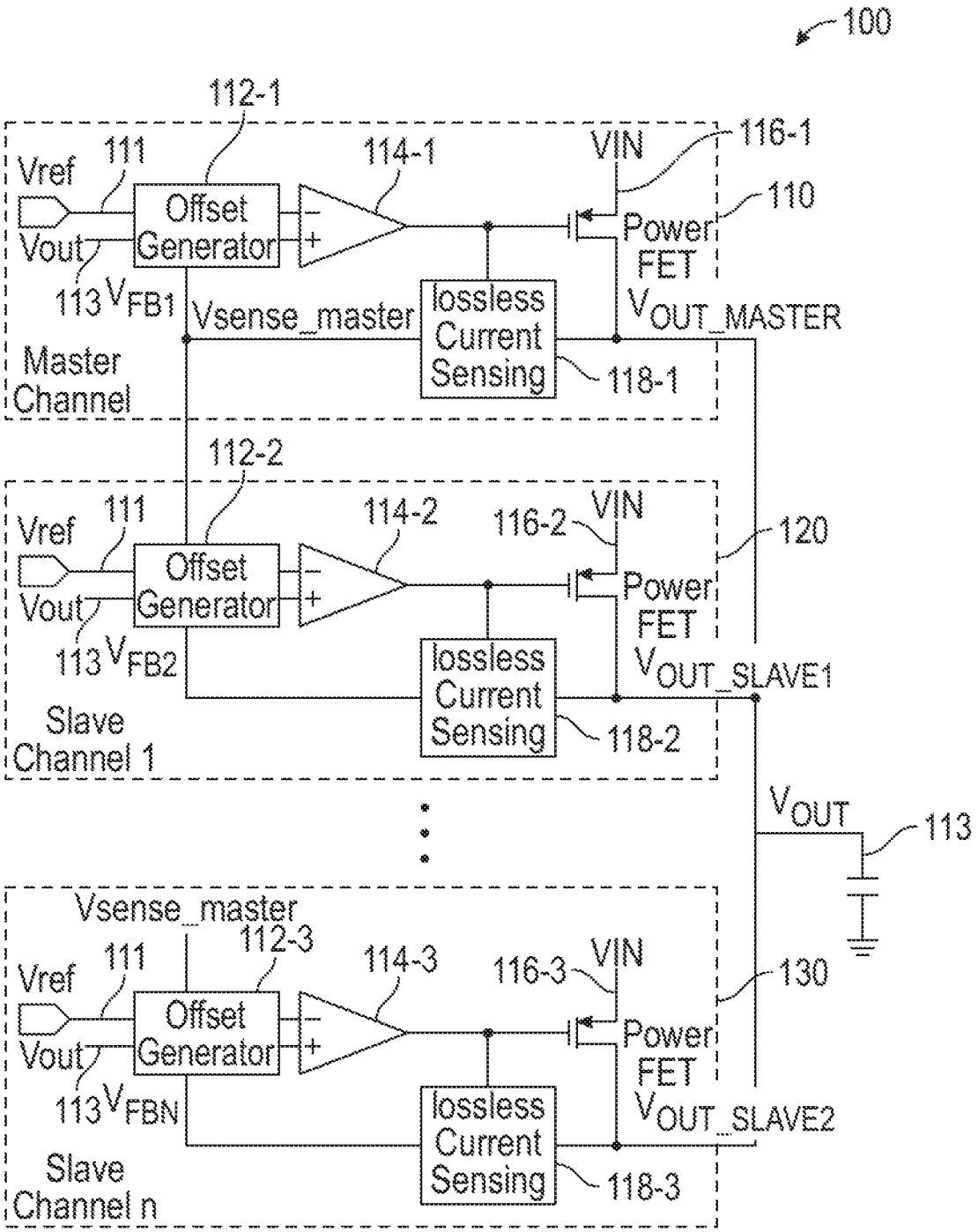
FIG. 1 illustrates a schematic diagram of a control circuit for lossless current balancing and sharing architecture between paralleled linear voltage regulators in accordance with one or more implementations of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced using one or more implementations. In one or more instances, structures and components are shown in block diagram form in order to avoid obscuring the concepts of the subject technology.

In particular applications, it is quite challenging to find an appropriate LDO regulator to meet the design target for both ultralow noise and high load current. Therefore, it may be beneficial to parallel LDO regulators for high current applications. Paralleling LDO regulators may provide benefits over a single LDO regulator, including distributing the heat and power loss across multiple LDO regulator packages in high loads. Also, paralleling LDO regulators can improve dropout voltage and improve power supply rejection ratio (PSRR) performance because each LDO regulator operates in a lower current condition when compared to a single LDO regulator.

Multi-channel power management integrated circuits (PMIC's) integrate multiple different power rails into a single integrated circuit (IC), to provide a wide range of power needs to the end application. In these PMIC's, a commonly used output power rail is a low dropout (LDO) linear voltage regulator, which can provide ultra low noise, fast transient response and high power supply rejection ratio (PSRR) performance to power-noise-sensitive analog, RF and mixed-signal applications. A fundamental issue in the PMIC's is that not every rail in the IC can meet the power or load current requirements of each system application. Therefore, an approach that gives the flexibility to increase the current load requirements for each unique system application is desirable.

Two LDO regulators are generally not connected in parallel to achieve current sharing because the output voltage between the LDO regulators can be mismatched due to tolerance errors, such as different LDO reference voltages, mismatching feedback resistors, and mismatching printed circuit board (PCB) parasitics. The mismatching output voltage between LDO regulators can introduce significant load current unbalance. In the worst case, it can potentially cause one LDO to dominate most of the load so that it reaches the current-limit protection.

In some approaches, a serial resistor may be used to sense the current for each channel. For example, in a passive current sharing method, the circuit topology may add identical ballast resistors at the output of each regulator to improve the passive current sharing between multiple LDO regulators. To achieve better passive current sharing performance, a large ballast resistance may be preferred. However, the large ballast resistance degrades its load regulation and increases the dropout voltage, thereby adversely impacting the sharing accuracy. Compared with the passive current sharing method, another approach is an active current sharing method that uses the active current sharing loop to achieve the current balance between the slave and the master LDO regulators. Although the sharing accuracy for an active current sharing method may be higher, the sensing resistor in the circuit topology requires additional power consumption. The additional power consumption in the power loop is unacceptable for high power applications.

The subject disclosure provides for the paralleling of monolithic embedded LDO power rails to provide additional load current, while maintaining accurate current sharing and balancing between paralleled LDOs without additional power consumption in a heavy load. This allows more flexibility in the PMIC to satisfy additional load current requirements in a wide range of system applications.

In some implementations of the subject technology, lossless current sensing is used to sense the current for each channel and produce corresponding voltages for comparison. For example, an offset generator block may compare the voltage for a first channel (e.g., master channel) and a second channel (e.g., slave channel), and generate an offset voltage according to the current error. In some aspects, the current error corresponds to a difference between the master channel voltage and the slave channel voltage. The offset voltage is added between an input reference voltage (e.g., VREF) and an output regulated voltage (e.g., VOUT) to cancel the DC offset of each channel, so the current of each channel is substantially the same.

The lossless current sensing can be realized with virtual equivalent series resistance (ESR) compensation or current limit sensing. Therefore, no additional power loss or area is required. The offset generator can be realized with a resistor and current mirror topology or an input pair added to an error amplifier input, which also is not a significant cost in area or power.

In some implementations, an apparatus for lossless current sharing between paralleled voltage regulators is provided. For example, the apparatus includes a first regulator circuit for driving a load with a first output voltage. The apparatus also includes one or more second regulator circuits coupled in parallel to the first regulator circuit and configured to drive the load with respective second output voltages. In some aspects, the first output voltage is compared to each of the respective second output voltages to determine offset voltages for each of the first regulator circuit and the one or more second regulator circuits. In other aspects, based on the determined offset voltages, respective signals are provided to the one or more second regulator circuits to cause the one or more second regulator circuits to adjust the respective second output voltages such that output currents of the one or more second regulator circuits correspond to an output current of the first regulator circuit.

FIG. 1 illustrates a schematic diagram of a control circuit 100 for lossless current balancing and sharing architecture between paralleled linear voltage regulators in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The control circuit 100 provides several advantages over the prior approaches, among others, the offset voltage produced from the sensed shared current can be added between the input reference voltage signal and output regulated voltage signal to cancel the DC offset of each channel, so the current of each channel is substantially the same. The control circuit 100 includes N channels, where N is a positive integer value. In FIG. 1, the control circuit 100 includes a first channel 110 that represents a master channel, a second channel 120 that represents a first slave channel, and a third channel 130 that represents a second slave channel. The number of channels connected in parallel may be arbitrary depending on implementation and the number may vary from that shown in FIG. 1. The channels are connected in parallel to one another and respectively drive a regulated voltage to a dynamic load circuit. The control circuit 100 produces an output voltage 113 that is a byproduct of the output voltages produced by the paralleled channels. The control circuit 110 is configured to maintain the output voltage 113 at a target steady voltage (e.g., voltage rail) for the dynamic load circuit. The control circuit 100 is designed to drive a wide variety of load circuits. Some examples of such load circuits are a mixed-signal product, a processor, an amplifier, a digital to analog converter or a pulse width modulation switching regulator.

The first channel 110 includes an offset generator 112-1, an error amplifier 114-1, a power transistor 116-1, and a current sensor 118-1. The first channel 110 produces a master output voltage that facilitates in producing the output voltage 113. The offset generator 112-1 is coupled to an input reference voltage 111 received from a reference voltage source (not shown) and to the output voltage 113 (e.g., $V_{OUT}$).

The offset generator 112-1 is coupled to the error amplifier 114-1 and supplies an offset voltage to at least one of the two inputs to the error amplifier 114-1, which may be added with the input reference voltage 111 at a first input to the error amplifier 114-1 and/or added with the load output voltage 113 at a second input to the error amplifier 114-1. For example, the voltage driven to either of the two inputs to the error amplifier 114-1 may be a voltage division between the offset voltage and the output voltage 113. In some implementations, the offset generator 112-1 senses the current of the first channel 110 (e.g., by measuring a corresponding voltage $V_{SENSE_MASTER}$), and drives its output to the offset generators (e.g., 112-2, 112-3) in the slave channels (e.g., 120, 130) to adjust their output voltage to balance the load current.

The output of the error amplifier 114-1 is coupled to the power transistor 116-1 and the current sensor 118-1. The error amplifier 114-1 drives an error amplifier signal to a gate of the power transistor 116-1 to charge the gate to a particular gate voltage. The power transistor 116-1 is turned on by the error amplifier signal (e.g., the gate is charged to the particular gate voltage) to pass a supply voltage (e.g., VIN) to the output as the output voltage for the first channel 110 (e.g., $V_{OUT_MASTER}$). While FIG. 1 depicts the channel output voltages (e.g., $V_{OUT_MASTER}$ $V_{OUT_SLAVE1}$, and $V_{OUT_SLAVE2}$) and the output voltage (e.g., $V_{OUT}$) as being directly coupled, it is understood that each channel voltage output may be individually driven and/or buffered separately by one or more circuit elements (e.g., resistors, buffers, inverters) to the load. For example, the paralleled channels may drive balanced voltages individually to the load such that the channels share the current over the load current range.

The current sensor 118-1 is configured to measure how much current of the first channel 110 is being drawn at the load by measuring the corresponding voltage for the first channel 110 (e.g., $V_{SENSE_MASTER}$). In some aspects, the $V_{SENSE_MASTER}$ signal facilitates in producing a feedback voltage (e.g., $V_{FB1}$) along the feedback loop path. In this respect, the feedback voltage $V_{FB1}$ corresponds to the measured current of the first channel 110. The current sensor 118-1 may produce the feedback voltage $V_{FB1}$ (or $V_{SENSE_MASTER}$ signal) with an impedance network along the feedback loop. In some aspects, the impedance network includes an equivalent series resistance element (e.g., a resistor).

The offset generator 112-1 uses the feedback voltage ($V_{FB1}$) and the output voltage 113 to generate the offset voltage that corrects for any difference in voltage between the voltage produced by the first channel 110 and the output voltage 113 that corresponds to the amount of current drawn at the load. For example, the offset generator 112-1 receives the feedback voltage (e.g., $V_{FB1}$) from the current sensor 118-1 and the output voltage 113. In some implementations, the offset generator 112-1 compares the feedback voltage $V_{FB1}$ directly with the input reference voltage 111.

In operation, when the load current increases, the output voltage 113 may decrease. In this respect, the feedback voltage decreases as well. As a result, the error amplifier 114-1 may generate more current into the gate of the power transistor 116-1. This reduces the voltage drop across the source-drain of the power transistor 116-1, and hence, increases the output voltage of the first channel 110 to a desired level, until the feedback voltage (e.g., $V_{FB1}$) equals the input reference voltage 111. On the other hand, if the output voltage goes up, in a similar way, the offset generator 112-1 and the error amplifier 114-1 increase the voltage drop across the power transistor 116-1 by decreasing the bias voltage to the gate of the power transistor 116-1 to ensure the accurate regulation of the output voltage 113.

The slave channels 120, 130 include a similar circuit topology as that of the first channel 110, where the channel components of the slave channels 120, 130 have functions that correspond to those of the first channel 110. For example, the second channel 120 includes an offset generator 112-2, an error amplifier 114-2, a power transistor 116-2, and a current sensor 118-2. The offset generator 112-2 is coupled to the input reference voltage 111 and to the output voltage 113. The current sensor 118-2 senses the slave channel current at the load by measuring the corresponding feedback voltage (e.g., $V_{FB2}$) along a feedback loop and drives the feedback voltage $V_{FB2}$ to the offset generator 112-2. As shown in FIG. 1, the offset generator 112-2 also receives the feedback voltage $V_{FB1}$ from the first channel 110. The offset generator 112-2 may use the feedback voltages of both channels (e.g., 110, 120) to generate the offset voltage to correct for any difference in voltage produced by the second channel 120 and the output voltage 113 that corresponds to the amount of current drawn at the load. For example, the offset generator 112-2 compares the feedback voltage $V_{FB1}$ with the feedback voltage $V_{FB2}$ to determine a current error signal (or corresponding offset voltage for the slave channel 120). The offset voltage may be voltage divided with the output voltage 113 to produce an offset-corrected voltage that is compared to the input reference voltage 111 by the error amplifier 114-2. In some aspects, the offset voltage may be voltage divided with the input reference voltage 111 to be compared with the output voltage 113 instead.

Similarly, the third channel 130 includes an offset generator 112-3, an error amplifier 114-3, a power transistor 116-3, and a current sensor 118-3. The offset generator 112-3 is coupled to the input reference voltage 111 and to the output voltage 113. The current sensor 118-3 senses the slave channel current at the load by measuring the corresponding feedback voltage (e.g., $V_{FBN}$) along a feedback loop and drives the feedback voltage $V_{FBN}$ to the offset generator 112-3. As shown in FIG. 1, the offset generator 112-3 receives the feedback voltage $V_{FB1}$ from the first channel 110. The offset generator 112-3 uses the feedback voltages of both channels (e.g., 110, 130) to generate the offset voltage to correct for any difference in voltage produced by the third channel 130 and the output voltage 113 that corresponds to the amount of current drawn at the load. For example, the offset generator 112-3 compares the feedback voltage $V_{FB1}$ with the feedback voltage $V_{FBN}$ to determine a current error signal (or corresponding offset voltage for the slave channel 130). The offset voltage may be voltage divided with the output voltage 113 to produce an offset-corrected voltage that is compared to the input reference voltage 111 by the error amplifier 114-3. In some aspects, the offset voltage may be voltage divided with the input reference voltage 111 to be compared with the output voltage 113 instead.

Figure 2:
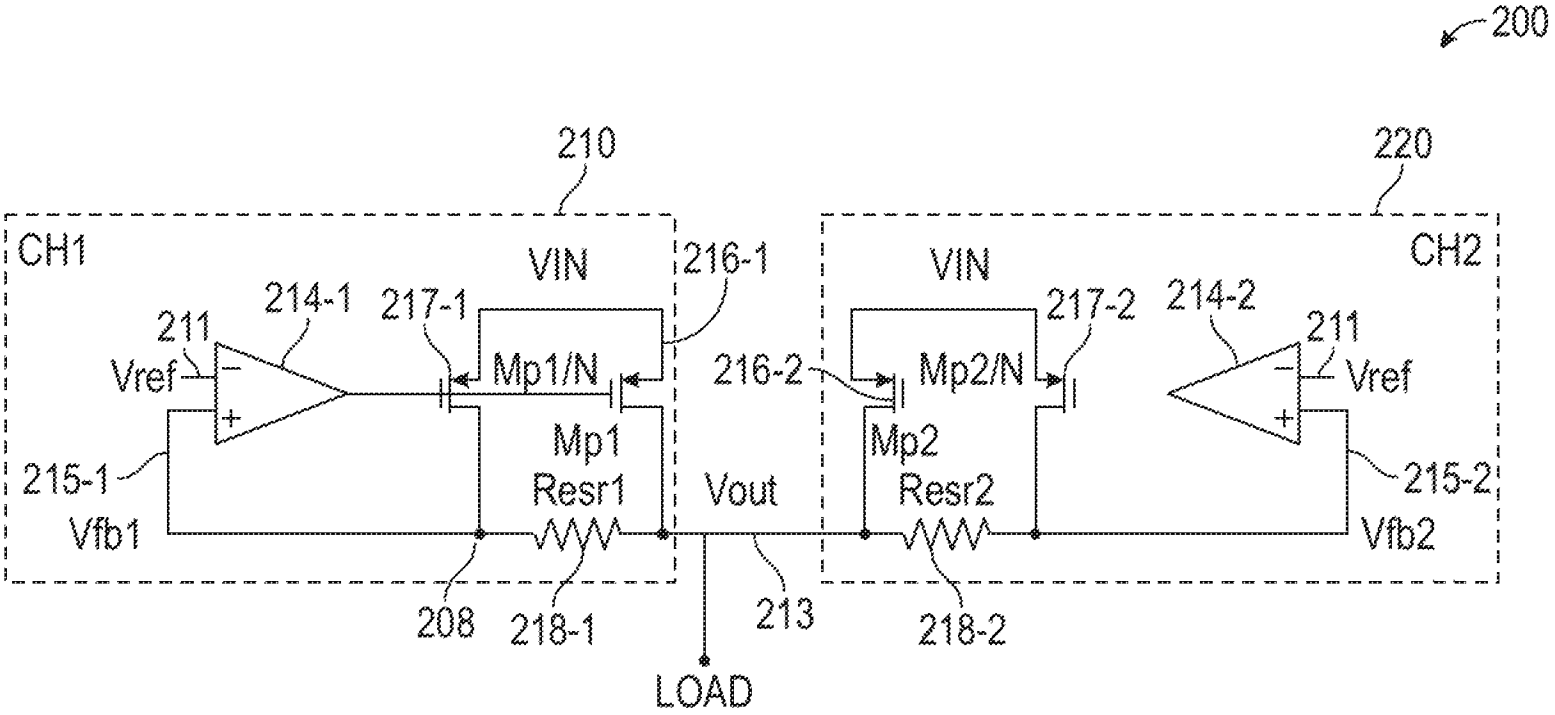
FIG. 2 illustrates a schematic diagram of an example of a control circuit with a first circuit realization for current sensing and offset generator components in FIG. 1 in accordance with one or more implementations of the subject technology.

FIG. 2 illustrates a schematic diagram of an example of a control circuit 200 with a first circuit realization for current sensing and offset generator components in FIG. 1 in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The control circuit 200 depicts a first channel 210 and a second channel 220, where the first channel 210 is a master channel and the second channel 220 is a slave channel. Each of the first channel 210 and the second channel 220 utilize a negative feedback loop in a LDO amplifier application, where each channel is configured as an LDO regulator circuit. An LDO regulator is a circuit that provides a well-specified and stable DC voltage. The lowest value of differential (input/output) voltage at which the control loop stops regulating is called the dropout voltage. Modern applications such as communication electronics and other battery-powered portable devices typically use a low dropout voltage and low quiescent currents for increased power efficiency. LDO regulators meet both of these design needs.

For purposes of explanation and brevity, the operation of the control circuit 200 will be discussed primarily in reference to the first channel 210 and its sub-components since the second channel 220 and its sub-components have a corresponding circuit topology and have functions that correspond to those of the first channel 210.

The first channel 210 includes an amplifier 214-1, a power transistor 216-1, a feedback transistor 217-1, and a resistor 218-1. In some aspects, the current sensor 118-1 includes the feedback transistor 217-1. In some aspects, the offset generator 112-1 includes the resistor 218-1. The second channel 220 includes a similar circuit topology as that of the first channel 210, where the channel components of the second channel 220 have functions that correspond to those of the first channel 210. For example, the second channel 220 includes an amplifier 214-2, a power transistor 216-2, a feedback transistor 217-2, and a resistor 218-2. In some aspects, the current sensor 118-2 includes the feedback transistor 217-2. In some aspects, the offset generator 112-2 includes the resistor 218-2. In some implementations, the resistor 218-1 has a resistance that corresponds to that of the resistor 218-2 such that the first channel 210 and the second channel 220 have a corresponding (or shared) current value. In some aspects, the amplifiers 214-1 and 214-2 are dual-stage differential amplifiers.

At the input stage of the first channel 210, the input reference voltage 211 (e.g., VREF) is fed into the inverting input of the amplifier 214-1. The output from the amplifier 214-1 controls a power transistor 216-1 that acts as a switch for supplying current from the power source (VIN) to a dynamic load (coupled to the output node (VOUT)). Some of the current flowing between the source and the drain of the power transistor 216-1 is then fed back through an equivalent series resistance (ESR) network into the non-inverting input of the amplifier 214-1. This feedback signal is called VFB1 (e.g., 215-1). The ESR network includes a resistor 218-1 (e.g., RESR1).

The output signal (VOUT) of the first channel 210 is fed back through the ESR network yielding the signal VFB1 (e.g., 215-1) at the non-inverting input of the amplifier 214-1. Similarly, the output signal (VOUT) of the second channel 220 is fed back through its ESR network yielding the signal VFB2 (e.g., 215-2) at the non-inverting input of the amplifier 214-2. Typically, differential amplifiers are used in modern electronic circuits. Differential amplifiers amplify the voltage difference between two input signals. When the output of a differential amplifier is connected to its inverting input and a reference voltage signal is applied to the non-inverting input, the output voltage of the differential amplifier closely follows that reference voltage. As the amplifier output increases, that output voltage is fed back to the inverting input, thereby acting to decrease the voltage differential between the inputs. When the input differential is reduced, the amplifier output and the system gain are also reduced. In FIG. 2, because the amplifier 214-1 is a dual-stage amplifier, the reference signal 211 is shown connected to the inverting input rather than the non-inverting input. Nevertheless, because the output is fed back in a manner that reduces the system gain, the result is negative feedback, sometimes called degenerative feedback.

The drain of the feedback transistor 217-1 connects to the non-inverting input of the amplifier 214-1. The gate of the power transistor 216-1 is connected to the gate of the feedback transistor 217-1, allowing the feedback transistor 217-1 to function as a current mirror that outputs a scaled version of the current flowing through the power transistor 216-1. The current flowing through the feedback transistor 217-1 is supplied to the feedback loop and to the ESR network. The voltage produced at node 208 contributes to signal VFB1.

The scaling factor is adjusted by varying the width of the feedback transistor 217-1. In FIG. 2, the scaling factor corresponds to MP1/N, where N is a positive integer and MP1 is the width size of the power transistor 216-1. In some aspects, N is in a range of 10 to 100 depending on size and the amount of current. If the width of the feedback transistor 217-1 is increased, more current flows through the feedback loop, thus increasing the gain around the feedback loop and the ESR network. Because the size of the power transistor 216-1 is determined by the maximum current that it is required to supply, the width of the power transistor 216-1 can remain the same for a given load.

The power transistor 216-1 may be a p-channel transistor in some implementations, or may be an n-channel transistor in other implementations. Similarly, the feedback transistor 217-1 may be a p-channel transistor in some implementations, or may be an n-channel transistor in other implementations. The resistor 218-1 is coupled between second terminals of the power transistor 216-1 and the feedback transistor 217-1. In some aspects, the first terminals are source terminals and the second terminals are drain terminals when the power transistor 216-1 and the feedback transistor 217-1 are implemented as p-channel transistors.

In some aspects, the first terminals of the power transistor 216-1 and the feedback transistor 217-1 are connected to one another and tied to a common supply voltage (e.g., VIN). Similarly, the first terminals of the power transistor 216-2 and the feedback transistor 217-2 are connected to one another and tied to a common supply voltage (e.g., VIN). Like the feedback transistor 217-1, the feedback transistor 217-2 has a size that is N times smaller than that of the power transistor 216-2 (e.g., MP2/N), where N is a positive integer and MP2 is the width size of the power transistor 216-2.

Figure 3A:
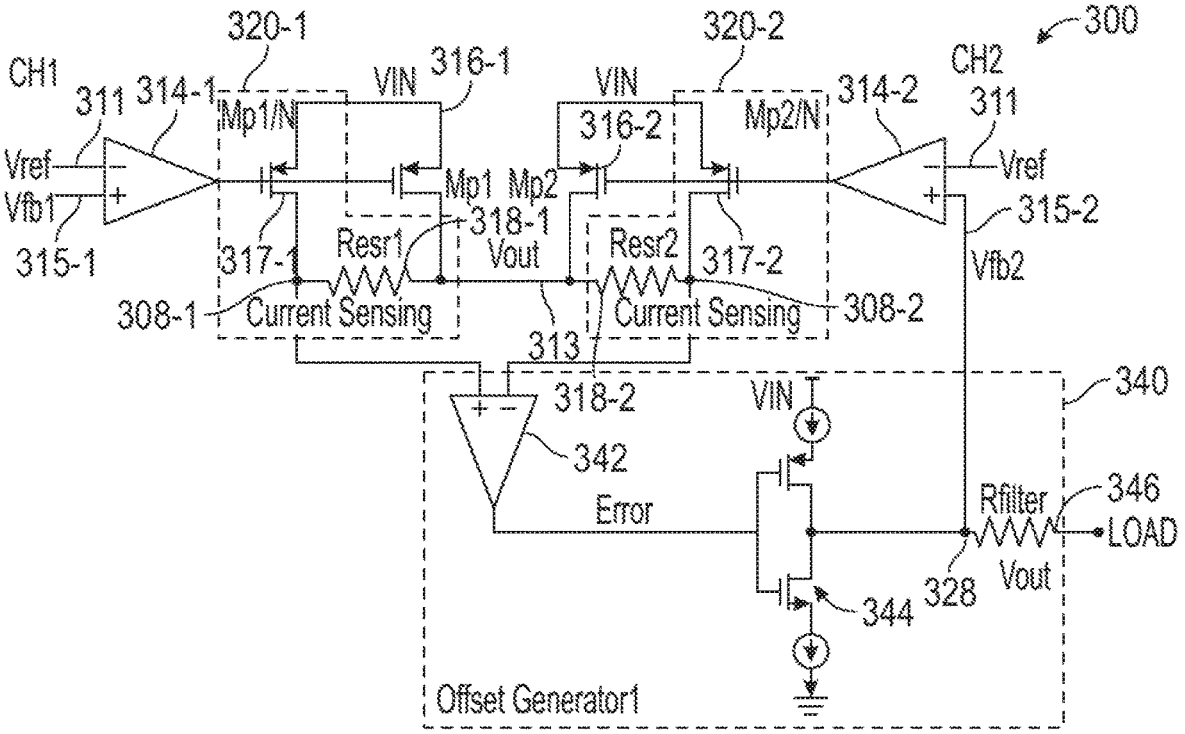
FIG. 3A illustrates a schematic diagram of an example of a control circuit with a second circuit realization for the current sensing and offset generator components in FIG. 2 in accordance with one or more implementations of the subject technology.

FIG. 3A illustrates a schematic diagram of an example of a control circuit 300 with a second circuit realization for the current sensing and offset generator components in FIG. 1 in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The control circuit 300 depicts a master channel and a slave channel with components that correspond to those of the master channel 210 and the slave channel 220, respectively, of FIG. 2. For purposes of explanation and brevity, only the differences depicted in FIG. 3A relative to FIG. 2 will be discussed. Additionally, the operation of the control circuit 300 will be discussed primarily in reference to the master channel and its sub-components since the slave channel and its sub-components have a corresponding circuit topology and have functions that correspond to those of the master channel.

The control circuit 300 adds a loop in the offset generator to cancel the load regulation error. This circuit topology can yield relatively good current sharing performance and the loop bandwidth for error cancellation is relatively low. In some aspects, this circuit topology can achieve current sharing accuracy of less than 1%. In some aspects, the offset voltage may not influence the load current sharing during dropout since the control loop is open. The current sharing may be determined by power transistor mismatch and the loop recovery time may be determined by the loop bandwidth of the offset cancellation.

In FIG. 3A, the master channel includes an error amplifier 314-1, a power transistor 316-1, and a current sensing circuit 310-1. The current sensing circuit 310-1 includes a feedback transistor 317-1 and an ESR resistor 318-1. The slave channel includes an error amplifier 314-2, a power transistor 316-2, and a current sensing circuit 310-2. The current sensing circuit 310-2 includes a feedback transistor 317-2 and an ESR resistor 318-2. The inverting inputs of the error amplifiers 314-1 and 314-2 are biased with an input reference voltage 311 (VREF), and the non-inverting inputs of the error amplifiers 314-1 and 314-2 are biased with respective feedback voltages 315-1 (VFB1) and 315-2 (VFB2). The master and slave channels are coupled to a common offset generator 340. The offset generator 340 includes an error amplifier 342, a current source inverter 344, and a load resistor 346.

The sensed master channel current at the node 308-1, which is located between the drain node of the feedback transistor 317-1 and the ESR resistor 318-1, is fed into the non-inverting input of the error amplifier 342. Similarly, the sensed slave channel current at the node 308-2, which is located between the drain node of the feedback transistor 317-2 and the ESR resistor 318-2, is fed into the inverting input of the error amplifier 342. The error amplifier 342 compares the master channel voltage to the slave channel voltage to generate an error signal. The current source inverter 344 is biased with the error signal to generate the offset voltage between the output 313 (e.g., VOUT) and the feedback voltage 315 (e.g., VFB2). In this respect, the offset voltage equals to $I_{OFF}*R_{FILTER}$, where $I_{OFF}$ is the output current of the current source inverter 344 and $R_{FILTER}$ is the resistance of the load resistor 346. Since a mismatch exists between the two LDO control loops, the offset voltage is used to cancel the DC offset and obtain high current sharing performance of the two LDO control loops. In some aspects, the load resistor 346 is used to form the output voltage at the desired value. The voltage produced at node 328 contributes to the signal VFB2 (e.g., 315-2). In some aspects, the load resistor 346 has a resistance less than 700 ohms. In other aspects, the load resistor 346 has a resistance in a range of about 1 k ohms to about 2 k ohms.

Figure 3B:
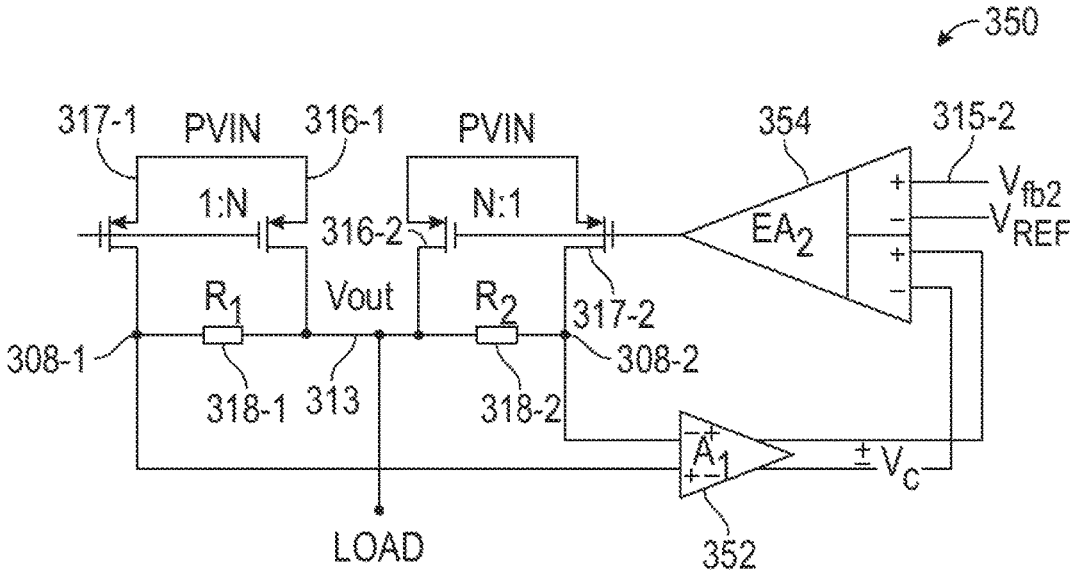
FIG. 3B illustrates a schematic diagram of an example of a control circuit with an alternative circuit realization for the offset generator component in FIG. 3A in accordance with one or more implementations of the subject technology.

FIG. 3B illustrates a schematic diagram of an example of a control circuit 350 with an alternative circuit realization for the offset generator component in FIG. 3A in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The control circuit 350 depicts a master channel and a slave channel with components that correspond to those of the control circuit 300 of FIG. 3A. For purposes of explanation and brevity, only the differences depicted in FIG. 3B relative to FIG. 3A will be discussed. Additionally, the operation of the control circuit 350 will be discussed primarily in reference to the master channel and its sub-components since the slave channel and its sub-components have a corresponding circuit topology and have functions that correspond to those of the master channel.

The offset generator circuit as depicted in FIG. 3B differs, in part, from that shown in FIG. 3A. For example, the offset generator includes a fully-differential amplifier 352 and a differential difference amplifier 354. In FIG. 3B, the sensed master channel current at the node 308-1, which is located between the drain node of the feedback transistor 317-1 and the ESR resistor 318-1, is fed into the non-inverting input of the fully-differential amplifier 352. Similarly, the sensed slave channel current at the node 308-2, which is located between the drain node of the feedback transistor 317-2 and the ESR resistor 318-2, is fed into the inverting input of the fully-differential amplifier 352. The fully-differential amplifier 352 compares the master channel voltage to the slave channel voltage to generate a differential error signal, where the positive polarity of the error signal is output from the non-inverting output of the fully-differential amplifier 352 and the negative polarity of the error signal is output from the inverting output of the fully-differential amplifier 352.

The positive polarity of the error signal is then fed into the non-inverting input of a first transconductance element of the differential difference amplifier 354 and the negative polarity of the error signal is then fed into the inverting input of the first transconductance element of the differential difference amplifier 354. The input reference voltage 311 is fed into the inverting input of a second transconductance element of the differential difference amplifier 354 and the feedback voltage signal 315-2 (VFB2) is fed into the non-inverting input of the second transconductance element of the differential difference amplifier 354. The output signal from the differential difference amplifier 354 drives the gates of the feedback transistor 317-2 and the power transistor 316-2.

Figure 4A:
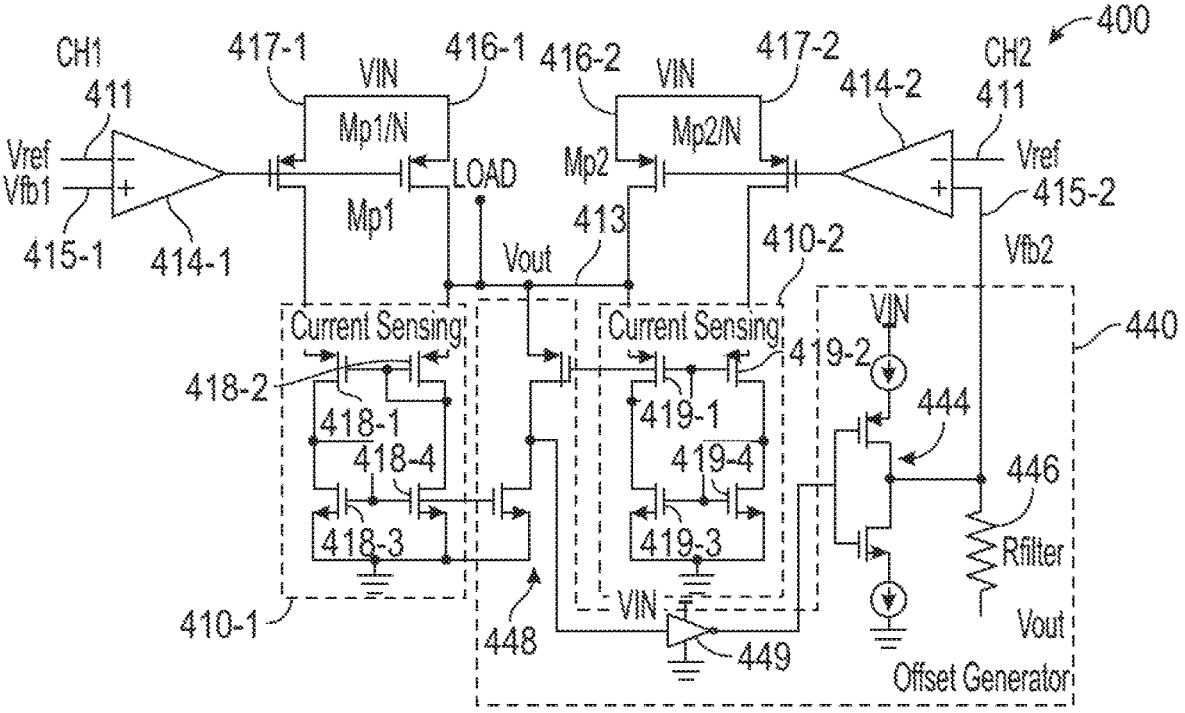
FIG. 4A illustrates a schematic diagram of an example of a control circuit with a third circuit realization for the current sensing and offset generator components in FIG. 1 in accordance with one or more implementations of the subject technology.

FIG. 4A illustrates a schematic diagram of an example of a control circuit 400 with a third circuit realization for the current sensing and offset generator components in FIG. 1 in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The control circuit 400 depicts a master channel and a slave channel with components that correspond to those of the control circuit 300 of FIG. 3A. For purposes of explanation and brevity, only the differences depicted in FIG. 4A relative to FIG. 3A will be discussed. Additionally, the operation of the control circuit 400 will be discussed primarily in reference to the master channel and its sub-components since the slave channel and its sub-components have a corresponding circuit topology and have functions that correspond to those of the master channel.

In FIG. 4A, the master channel includes an error amplifier 414-1, a power transistor 416-1, a feedback transistor 417-1, and a current sensing circuit 410-1. The current sensing circuit 410-1 includes sense transistors 418-1, 418-2, 418-3 and 418-4, where the sense transistors 418-1 and 418-2 are p-channel transistors and the sense transistors 418-3 and 418-4 are n-channel transistors. The slave channel includes an error amplifier 414-2, a power transistor 416-2, a feedback transistor 417-2, and a current sensing circuit 410-2. The current sensing circuit 410-2 includes sense transistors 419-1, 419-2, 419-3 and 419-4, where the sense transistors 419-1 and 419-2 are p-channel transistors and the sense transistors 419-3 and 419-4 are n-channel transistors. The inverting inputs of the error amplifiers 414-1 and 414-2 are biased with an input reference voltage 411 (VREF), and the non-inverting inputs of the error amplifiers 414-1 and 414-2 are biased with respective feedback voltages 415-1 (VFB1) and 415-2 (VFB2). The master and slave channels are coupled to a common offset generator 440. The offset generator 440 includes a current source inverter 444, a load resistor 446, a switch network 448, and a circuit element 449. In some implementations, the circuit element 449 is an inverter. In other implementations, the circuit element 449 is a level shifter that transfers the incoming signal from a first domain (e.g., $0\sim V_{OUT}$ domain) to a second domain (e.g., $0\sim V_{1N}$ domain).

In the master channel, the drain of the feedback transistor 417-1 is tied to the source of the sense transistor 418-1 of the current sensing circuit 410-1. The drain of the power transistor 416-1 is tied to the source of the sense transistor 418-2 of the current sensing circuit 410-1. The drains of the sense transistor 418-2 and the sense transistor 418-4 are tied to the gates of the sense transistors 418-1 and 418-2. The drains of the sense transistor 418-1 and the sense transistor 418-3 are tied to the gates of the sense transistors 418-3 and 418-4. Additionally, the drains of the sense transistor 418-1 and the sense transistor 418-3 are tied to the gate of a first transistor in the switch network 448 of the offset generator 440 to mirror the master channel current into the offset generator 440. The sources of the sense transistors 418-3 and 418-4 are tied to ground.

In the slave channel, the drain of the feedback transistor 417-2 is tied to the source of the sense transistor 419-2 of the current sensing circuit 410-2. The drain of the power transistor 416-2 is tied to the source of the sense transistor 419-1 of the current sensing circuit 410-2. The drains of the sense transistor 419-1 and the sense transistor 419-3 are tied to the gates of the sense transistors 419-1 and 419-2. The drains of the sense transistor 419-2 and the sense transistor 419-4 are tied to the gates of the sense transistors 419-3 and 419-4. Additionally, the drains of the sense transistor 419-1 and the sense transistor 419-3 are tied to the gate of a second transistor in the switch network 448 of the offset generator 440 to mirror the slave channel current into the offset generator 440. The sources of the sense transistors 419-3 and 419-4 are tied to ground. In some aspects, selection between the master channel current and the slave channel current in the offset generator 440 may be based on the respective current sensing values sufficient to conduct (or turn on) the respective transistor of the switch network 448 and drive the inverter 449.

Figure 4B:
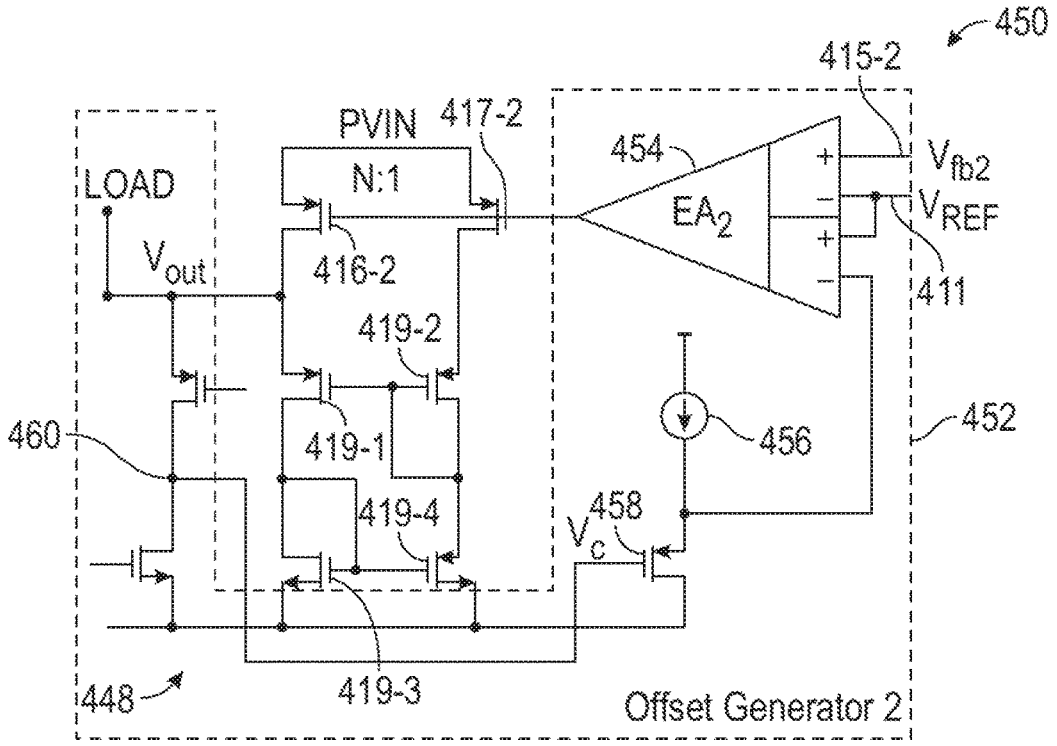
FIG. 4B illustrates a schematic diagram of an example of a control circuit with an alternative circuit realization for the offset generator component in FIG. 4A in accordance with one or more implementations of the subject technology.

FIG. 4B illustrates a schematic diagram of an example of a control circuit 450 with an alternative circuit realization for the offset generator component in FIG. 4A in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The control circuit 450 depicts a master channel and a slave channel with components that correspond to those of the control circuit 400 of FIG. 4A. For purposes of explanation and brevity, only the differences depicted in FIG. 4B relative to FIG. 4A will be discussed. Additionally, the operation of the control circuit 450 will be discussed primarily in reference to the master channel and its sub-components since the slave channel and its sub-components have a corresponding circuit topology and have functions that correspond to those of the master channel.

The offset generator circuit as depicted in FIG. 4B differs, in part, from that shown in FIG. 4A. For example, the offset generator (e.g., 452) includes the switch network 448, a current source 456, a pass element 458, and a differential difference amplifier 454.

In FIG. 4B, the current sensing circuit (e.g., 410-2) for the slave channel differs, in part, from that shown in FIG. 4A. For example, the sources of the power transistor 416-2 and the feedback transistor 417-2 are tied to a common supply voltage (e.g., PVIN). The drain of the power transistor 416-2 is tied to the source of the sense transistor 419-1. The common node between the source of the sense transistor 419-1 and the drain of the power transistor 416-2 is tied to the output (or the load) and to the source of the second transistor in the switch network 448. The drain of the feedback transistor 417-2 is tied to the source of the sense transistor 419-2. The drains of the sense transistors 419-1 and 419-3 are tied to the gates of the sense transistors 419-3 and 419-4. The drains of the sense transistors 419-2 and 419-4 are tied to the gates of the sense transistors 419-1 and 419-2. Additionally, the drains of the sense transistors 419-2 and 419-4 are tied to the gate of the second transistor in the switch network 448 to mirror the slave channel current into the offset generator 440.

The sources of the sense transistors 418-3 and 418-4 are tied to the drain of the pass element 458. The output signal from the switch network 448 at node 460 drives the gate of the pass element 458 to control the passing of current from the current source 456 to the inverting input of a first transconductance element of the differential difference amplifier 454. The input reference voltage 411 (VREF) is fed into both the non-inverting input of the first transconductance element of the differential difference amplifier 454 and into the inverting input of a second transconductance element of the differential difference amplifier 454. The feedback voltage signal 415-2 (VFB2) is fed into the non-inverting input of the second transconductance element of the differential difference amplifier 454. The output signal from the differential difference amplifier 454 drives the gates of the feedback transistor 417-2 and the power transistor 416-2.

Figure 5:
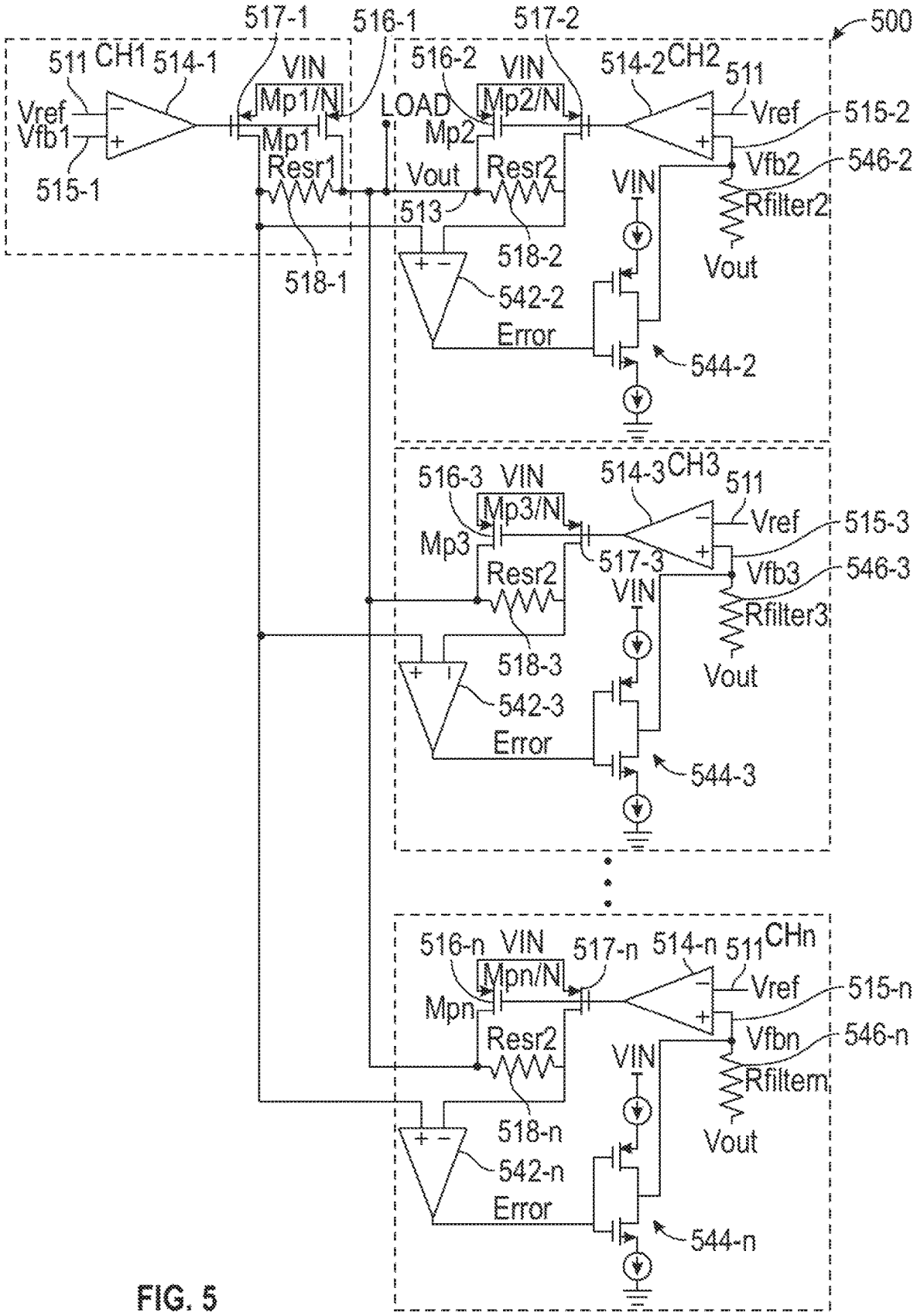
FIG. 5 illustrates a schematic diagram of an example of a control circuit with a first multiple channel realization of the lossless current balancing and sharing architecture of FIG. 1 with the circuit realization for the current sensing and offset generator components of FIG. 3A in accordance with one or more implementations of the subject technology.

FIG. 5 illustrates a schematic diagram of an example of a control circuit 500 with a first multiple channel realization of the lossless current balancing and sharing architecture of FIG. 1 with the circuit realization for the current sensing and offset generator components of FIG. 3A in accordance with one or more implementations of the subject technology. The control circuit 500 depicts a master channel and multiple slave channels, each with components and functions that correspond to those of the control circuit 300 of FIG. 3A. For purposes of explanation and brevity, only the differences depicted in FIG. 5 relative to FIG. 3A will be discussed. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

In FIG. 5, the master channel includes an error amplifier 514-1, a power transistor 516-1, and a first current sensing circuit. The first current sensing circuit includes a feedback transistor 517-1 and an ESR resistor 518-1. The inverting inputs of the error amplifiers 514-1 and 514-2 are biased with an input reference voltage 511 (VREF), and the non-inverting inputs of the error amplifiers 514-1 and 514-2 are biased with respective feedback voltages 515-1 (VFB1) and 515-2 (VFB2). The master channel is coupled to the offset generators of the individual slave channels.

The first slave channel includes an error amplifier 514-2, a power transistor 516-2, a second current sensing circuit, and a first offset generator. The second current sensing circuit includes a feedback transistor 517-2 and an ESR resistor 518-2. The first offset generator includes an error amplifier 542-2, a current source inverter 544-2, and a load resistor 546-2.

The second slave channel includes an error amplifier 514-3, a power transistor 516-3, a third current sensing circuit, and a second offset generator. The third current sensing circuit includes a feedback transistor 517-3 and an ESR resistor 518-3. The second offset generator includes an error amplifier 542-3, a current source inverter 544-3, and a load resistor 546-3.

The n-th slave channel includes an error amplifier **514-*n*, a power transistor 516-*n*, an n-th current sensing circuit, and an n-th offset generator. The n-th current sensing circuit includes a feedback transistor 517-*n* and an ESR resistor 518-*n*. The n-th offset generator includes an error amplifier 542-*n*, a current source inverter 544-*n*, and a load resistor 546-*n*, where n is an arbitrary and positive integer value that defines the number of channels implemented in the control circuit 500**.

Figure 6:
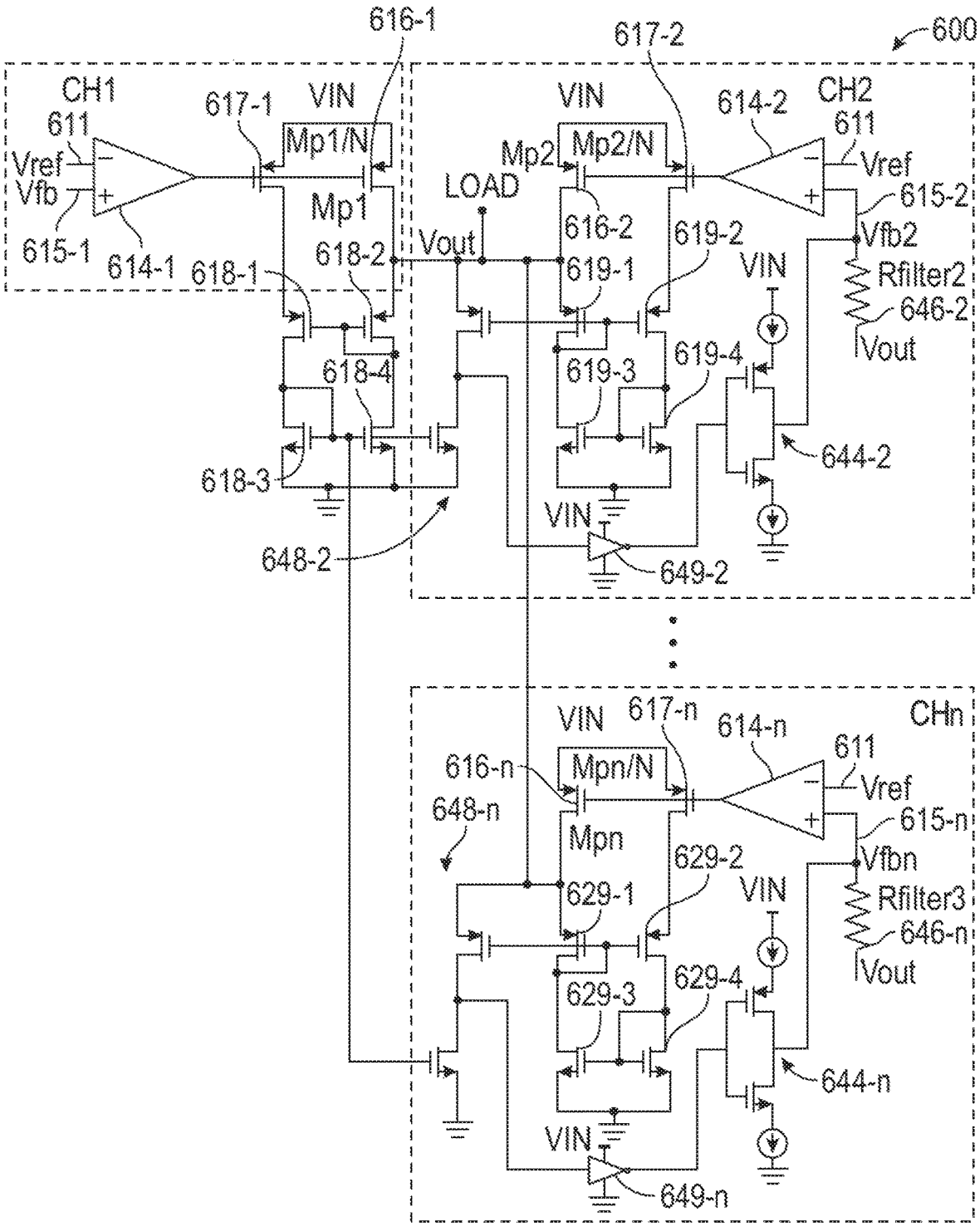
FIG. 6 illustrates a schematic diagram of an example of a control circuit with a second multiple channel realization of the lossless current balancing and sharing architecture of FIG. 1 with the circuit realization for the current sensing and offset generator components of FIG. 4A in accordance with one or more implementations of the subject technology.

FIG. 6 illustrates a schematic diagram of an example of a control circuit 600 with a second multiple channel realization of the lossless current balancing and sharing architecture of FIG. 1 with the circuit realization for the current sensing and offset generator components of FIG. 4A in accordance with one or more implementations of the subject technology. The control circuit 600 depicts a master channel and multiple slave channels, each with components and functions that correspond to those of the control circuit 400 of FIG. 4A. For purposes of explanation and brevity, only the differences depicted in FIG. 6 relative to FIG. 4A will be discussed. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

In FIG. 6, the master channel includes an error amplifier 614-1, a power transistor 616-1, a feedback transistor 617-1, and a first current sensing circuit. The first current sensing circuit includes sense transistors 618-1, 618-2, 618-3 and 618-4, where the sense transistors 618-1 and 618-2 are p-channel transistors and the sense transistors 618-3 and 618-4 are n-channel transistors.

The first slave channel includes an error amplifier 614-2, a power transistor 616-2, a feedback transistor 617-2, a second current sensing circuit, and a first offset generator. The second current sensing circuit includes sense transistors 619-1, 619-2, 619-3 and 619-4, where the sense transistors 619-1 and 619-2 are p-channel transistors and the sense transistors 619-3 and 619-4 are n-channel transistors. The first offset generator includes a current source inverter 444-2, a load resistor 446-2, a switch network 448-2, and an inverter 449-2.

The n-th slave channel includes an error amplifier **614-*n*, a power transistor 616-*n*, a feedback transistor 617-*n*, an n-th current sensing circuit, and an n-th offset generator, where n is an arbitrary and positive integer value that defines the number of channels implemented in the control circuit 600. The n-th current sensing circuit includes sense transistors 629-1, 629-2, 629-3 and 629-4, where the sense transistors 629-1 and 629-2 are p-channel transistors and the sense transistors 629-3 and 629-4 are n-channel transistors. The n-th offset generator includes a current source inverter 444-*n*, a load resistor 446-*n*, a switch network 448-*n*, and an inverter 449-*n***.

The inverting inputs of the error amplifiers 614-1 and 614-2 are biased with an input reference voltage 611 (VREF), and the non-inverting inputs of the error amplifiers 614-1 and 614-2 are biased with respective feedback voltages 615-1 (VFB1) and 615-2 (VFB2).

The inverting inputs of the error amplifiers 614-1, 614-2 and **614-*n* are biased with an input reference voltage 611** (VREF), and the non-inverting inputs of the error amplifiers

614-1, 614-2 and **614-*n* are biased with respective feedback voltages 615-1 (VFB1), 615-2 (VFB2) and 615-*n* (VFBN). The current sensing circuit of the master channel is coupled to the switch networks (e.g., 648-2, 648-*n***) of the individual slave channels to mirror the master channel current into the respective slave channel.

Figure 7:
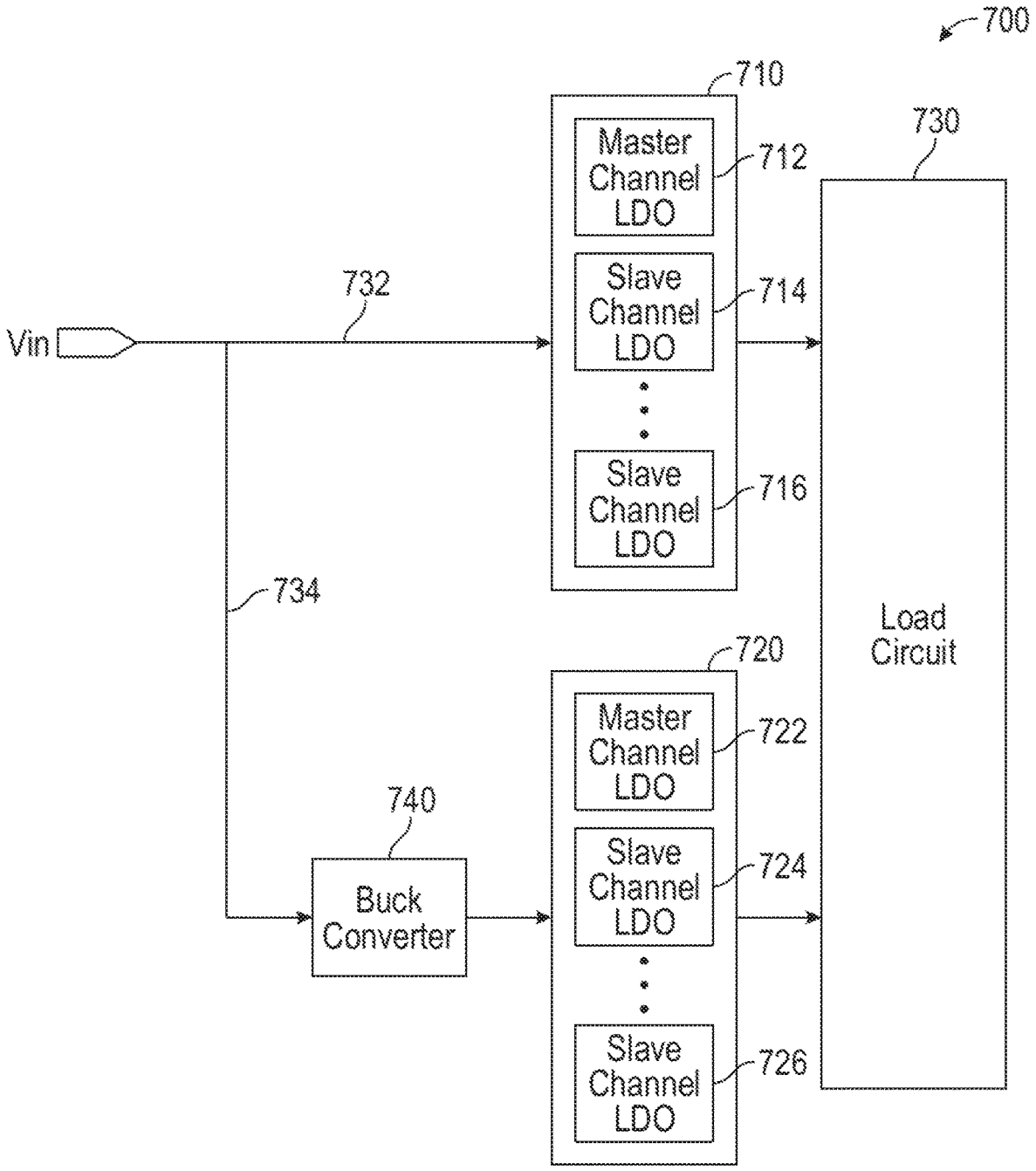
FIG. 7 conceptually illustrates a mixed-signal product with which any implementations of the subject technology are implemented.

FIG. 7 conceptually illustrates a mixed-signal product 700 with which any implementations of the subject technology are implemented. The mixed-signal product 700 includes a first set of paralleled linear regulators 710 along a first signal path 732 to a load circuit 730, and includes a second set of paralleled linear regulators 720 along a first signal path 734 to the load circuit 730. In some implementations, the first set of paralleled linear regulators 710 may include a circuit topology that corresponds to that of the control circuit 100 of FIG. 1, where a master channel with a first linear regulator (e.g., 712) is connected in parallel to one or more slave channels with respective linear regulators (e.g., 714, 716). Similarly, the second set of paralleled linear regulators 720 may include a circuit topology that corresponds to that of the control circuit 100 of FIG. 1, where a master channel with a first linear regulator (e.g., 722) is connected in parallel to one or more slave channels with respective linear regulators (e.g., 724, 726).

In FIG. 7, the first set of paralleled linear regulators 710 are arranged along the first signal path 732 to drive a first regulated voltage to the load 730. The second set of paralleled linear regulators 720 are arranged along the first signal path 734 to drive a second regulated voltage to the load 730. In some aspects, a power converter 740, such as a buck converter, may supply a regulated voltage to the second set of paralleled linear regulators 720, where the regulated voltage is step-down from an input voltage (VIN).

In some implementations, the load circuit 730 is a mixed-signal circuit, where the first and second regulated voltages provided respectively by the first and second sets of paralleled linear regulators (e.g., 710, 720) are different voltages. For example, the first regulated voltage may be a first core supply voltage of about 1.8 V to power low-voltage circuitry in the load circuit 730, whereas the second regulated voltage may be a second core supply voltage of about 1.0 V to power other low-voltage circuitry in the load circuit 730. In this respect, the first and second sets of paralleled linear regulators (e.g., 710, 720) with the current sharing circuit topologies as those discussed in FIGS. 3A, 3B, 4A, 4B, 5 and 6 facilitate the provisioning of different power rails for different load current requirements in a wide range of system applications.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An apparatus for lossless current sharing between paralleled linear voltage regulators, comprising:

a first linear voltage regulator circuit for driving a load with a first output voltage;

one or more second linear voltage regulator circuits coupled in parallel to the first linear voltage regulator circuit and configured to drive the load with respective second output voltages; and one or more channel circuits coupled to the first linear voltage regulator circuit and the one or more second linear voltage regulator circuits, the one or more channel circuits configured to:

compare the first output voltage to each of the respective second output voltages to determine offset voltages for each of the first linear voltage regulator circuit and the one or more second linear voltage regulator circuits; and provide, based on the determined offset voltages, respective signals to the first linear voltage regulator circuit and to the one or more second linear voltage regulator circuits to cause the first linear voltage regulator circuit and the one or more second linear voltage regulator circuits to adjust the first output voltage and the respective second output voltages such that respective second output currents of the one or more second linear voltage regulator circuits correspond to a first output current of the first linear voltage regulator circuit.

2. The apparatus of claim 1, wherein the one or more channel circuits comprises:

a first error amplifier circuit configured to compare a first reference voltage signal to a first feedback voltage signal and generate a first error signal;

a first power switching element configured to selectively pass a supply voltage to the load based on the first error signal from the first error amplifier circuit; and a first current sensing circuit configured to measure the first output current at the load.

3. The apparatus of claim 2, wherein the first current sensing circuit comprises:

a first feedback switching element configured to mirror the first output current and measure the first output current; and a first equivalent series resistance circuit element coupled between the first feedback switching element and a node coupling the first power switching element and the load.

4. The apparatus of claim 3, wherein the one or more channel circuits comprises:

a second error amplifier circuit configured to compare a second reference voltage signal to a second feedback voltage signal and generate a second error signal;

a second power switching element configured to selectively pass a supply voltage to the load based on the second error signal from the second error amplifier circuit; and a second current sensing circuit configured to measure one of the respective second output currents at the load.

5. The apparatus of claim 4, wherein the second current sensing circuit comprises:

a second feedback switching element configured to mirror the second output current and measure the second output current; and a second equivalent series resistance circuit element coupled between the second feedback switching element and a node coupling the second power switching element and the load.

6. The apparatus of claim 5, wherein inverting inputs of the first and second error amplifier circuits are biased with the first and second reference voltage signal, and wherein non-inverting inputs of the first and second error amplifier circuits are respectively biased with the first feedback voltage signal and the second feedback voltage signal.

7. The apparatus of claim 6, wherein the one or more channel circuits comprises a third error amplifier, a current source inverter, and a resistive circuit element.

8. The apparatus of claim 7, wherein the first current sensing circuit measures the first output current at a node between the first feedback switching element and the first equivalent series resistance circuit element and feeds the first output voltage into a non-inverting input of the third error amplifier.

9. The apparatus of claim 7, wherein the second current sensing circuit measures one of the respective second output currents at a node between the second feedback switching element and the second equivalent series resistance circuit element and feeds one of the respective second output voltages into an inverting input of the third error amplifier.

10. The apparatus of claim 7, wherein the third error amplifier compares the first output voltage to one of the respective second output voltages to generate a third error signal.

11. The apparatus of claim 10, wherein the current source inverter is biased with the third error signal to increase an output voltage to a supply voltage rail or to decrease the output voltage to ground.

12. The apparatus of claim 11, wherein the resistive circuit element produces the output voltage at a desired value, and wherein the output voltage produced contributes to producing the second feedback voltage signal into the second error amplifier circuit.

13. The apparatus of claim 7, wherein the first current sensing circuit measures the first output current at a node between the first feedback switching element and the first equivalent series resistance circuit element and feeds the first output voltage into a non-inverting input of a fully-differential amplifier.

14. The apparatus of claim 13, wherein the second current sensing circuit measures one of the respective second output currents at a node between the second feedback switching element and the second equivalent series resistance circuit element and feeds one of the respective second output voltages into an inverting input of the fully-differential amplifier, wherein the fully-differential amplifier drives a non-inverting output signal to a non-inverting input of a differential difference amplifier and an inverting output signal to an inverting input of the differential difference amplifier.

15. An apparatus for current sharing between paralleled linear voltage regulators, comprising:

a first linear voltage regulator configured to:

produce a first offset signal based on a comparison of a first output voltage of the first linear voltage regulator to a load output voltage;

bias the first linear voltage regulator with the first offset signal to correct for a difference in voltage between the first output voltage and the load output voltage; and a second linear voltage regulator coupled to opposing terminals of the first linear voltage regulator, wherein the second linear voltage regulator is configured to:

produce a second offset signal based on a comparison of a first output voltage of the first linear voltage regulator to a second output voltage of the second linear voltage regulator; and bias the second linear voltage regulator with the second offset signal to cancel a voltage offset between the first linear voltage regulator and the second linear voltage regulator.

16. The apparatus of claim 15, further comprising an offset generator circuit coupled to the first linear voltage regulator and the second linear voltage regulator, wherein the offset generator circuit comprises a fully-differential amplifier and a differential difference amplifier.

17. The apparatus of claim 16, wherein the fully-differential amplifier compares the first output voltage to the second output voltage to generate a differential error signal, and wherein a positive polarity of the differential error signal is output from a non-inverting output of the fully-differential amplifier and a negative polarity of the differential error signal is output from an inverting output of the fully-differential amplifier.

18. The apparatus of claim 17, wherein the positive polarity of the differential error signal is fed into a non-inverting input of a first transconductance element of the differential difference amplifier and a negative polarity of the differential error signal is fed into an inverting input of the first transconductance element of the differential difference amplifier.

19. The apparatus of claim 18, wherein an inverting input of a second transconductance element of the differential difference amplifier is biased with an input reference voltage and a non-inverting input of the second transconductance element of the differential difference amplifier is biased with a feedback voltage signal from the second linear voltage regulator.

20. A system for lossless current sharing between paralleled linear voltage regulators, comprising:

means for producing a first offset signal in the first linear voltage regulator based on a comparison of a first output voltage of a first linear voltage regulator to a load output voltage;

means for producing a second offset signal in a second linear voltage regulator based on a comparison of a first output voltage corresponding to a first output current of a first linear voltage regulator with a second output voltage corresponding to a second output current of a second linear voltage regulator;

means for biasing the first linear voltage regulator with the first offset signal to correct for a difference in voltage between the first output voltage and the load output voltage; and means for biasing the second linear voltage regulator with the second offset signal to cancel a voltage offset between the first linear voltage regulator and the second linear voltage regulator.

21. The system of claim 20, further comprising:

means for measuring the first output current of the first linear voltage regulator; and means for measuring the second output current of the second linear voltage regulator.

22. A method for lossless current sharing between paralleled linear voltage regulators, the method comprising:

producing a first offset signal in the first linear voltage regulator based on a comparison of a first output voltage of a first linear voltage regulator to a load output voltage;

producing a second offset signal in a second linear voltage regulator based on a comparison of a first output voltage corresponding to a first output current of a first linear voltage regulator with a second output voltage corresponding to a second output current of a second linear voltage regulator;

biasing the first linear voltage regulator with the first offset signal to correct for a difference in voltage between the first output voltage and the load output voltage; and biasing the second linear voltage regulator with the second offset signal to cancel a voltage offset between the first linear voltage regulator and the second linear voltage regulator.

23. The method of claim 22, further comprising:

measuring the first output current of the first linear voltage regulator; and measuring the second output current of the second linear voltage regulator.

* * * * *